US005433648A

United States Patent [19]

Frydman

[11] Patent Number: 5,433,648

[45] Date of Patent: Jul. 18, 1995

[54] ROTATABLE CLOSURE DEVICE FOR BRASSIERES AND HATS

[76] Inventor: Larry G. Frydman, 195 Charles Street, Thornhill, Ontario, Canada, L4J 3A2

[21] Appl. No.: 178,494

[22] Filed: Jan. 7, 1994

[51] Int. Cl.[6] ..... A41C 3/12

[52] U.S. Cl. ..... 450/78; 450/1; 450/41; 450/52; 450/71; 2/73; 2/183; 2/195.2; 24/68 SK; 24/71 ST

[58] Field of Search ..... 450/41, 42, 43, 44, 450/45, 46, 47, 48, 49, 50, 51, 52, 53, 71, 72, 73, 77, 78, 68; 2/73, 195.2, 171, 181.2, 181, 183, 181.4; 24/71.1, 68 D, 69 WT, 68 SK, 68 B, 71.2, 71 ST; 242/388.3, 388.4; 36/50.1, 50.5

[56] References Cited

U.S. PATENT DOCUMENTS

| | | | |
|---|---|---|---|
| 1,009,297 | 11/1911 | Gabeau | 450/45 |
| 1,472,796 | 11/1923 | Fritz | 450/48 |
| 2,180,180 | 11/1939 | Versoy | 450/71 X |
| 2,926,406 | 3/1960 | Edwards et al. | 24/68 B |
| 3,196,878 | 7/1965 | Hedu | 450/48 X |
| 3,214,809 | 11/1965 | Edwards | 24/68 B |
| 4,433,456 | 2/1984 | Baggio | 24/68 SK |
| 4,530,361 | 7/1985 | Wooten | 128/483 |
| 4,727,627 | 3/1988 | Baggio et al. | 24/68 SK |
| 4,741,719 | 5/1988 | Wirth | 450/30 |
| 4,872,218 | 10/1989 | Holt | 2/171 |
| 4,911,677 | 3/1990 | White | 450/36 |
| 4,992,074 | 2/1991 | Diaz | 450/81 |
| 5,031,246 | 7/1991 | Kronenberger | 2/197 |
| 5,042,177 | 8/1991 | Schoch | 36/117 |
| 5,045,019 | 9/1991 | Capasso et al. | 450/74 |
| 5,098,330 | 3/1992 | Greenberg | 450/55 |
| 5,140,707 | 8/1992 | Johnson | 2/8 |
| 5,331,687 | 7/1994 | Kronenberger | 2/195.2 |

*Primary Examiner*—Jeanette E. Chapman
*Attorney, Agent, or Firm*—Small Larkin & Kidde

[57] ABSTRACT

A ratchet spool mechanism including a rear or bottom housing having a central column, and positioned around the central column a belleville-type spring, positioned thereover a rotary spool having affixed therebetween two lengths of twine and positioned over the top portion of the spool a rotary cap having beveled projections which cooperate with correspondingly positioned orifices in the top surface of the rotary spool whereby operation of the belleville spring, the beveled surfaces and the orifices provide for a locking mechanism and one-way rotation to tighten or draw in the twine, and upon pressing the rotary cap downward against the belleville spring, the beveled projections become disengaged from the orifices, and the spool may be rotated in either direction.

13 Claims, 8 Drawing Sheets

ROTATABLE CLOSURE DEVICE FOR BRASSIERES AND HATS

DESCRIPTION

1. Field of the Invention

The field of the invention is spring loaded, station closure mechanisms and their intended uses to provide a locking function. When the spring is engaged the mechanism provides a locking function and one-way rotation. When the spring is disengaged, the mechanism provides for rotation in clockwise or counterclockwise direction. The preferred embodiments are adaptations for use in fastening or tightening brassieres, caps and the like.

Rotation closure mechanisms, such as described in U.S. Pat. No. 5,042,177 are known. However, the closure mechanism of that parent is relatively complicated, is limited to use as a rotation closure for a sports shoe/-ski boot, and has not been adapted for use in conjunction with a brassier, caps or other similar devices.

2. Summary and Objects of the Invention

A primary object of the present invention is to provide a simple, rotation closure spool mechanism which is small, simple in construction, and spring loaded so as to provide a locking feature which can be released upon pushing the front face of the cap of the device.

It is another object of the present invention to provide a rotation closure spool mechanism to be were in conjunction with a brassiere, or constructed within a brassiere proper and which can be adjusted through rotation, to provide variable degrees of support to the wearer, as well as vary breast separation and cleavage.

It is yet another object of the present invention to provide a rotation closure device for use in conjunction with hats so that the size of the hat may be adjusted to accommodate differently sized heads.

These and other objects of the present invention are attained by providing a rotation closure spool mechanism which includes a bottom or rear housing, cylindrical in shape and having a central, cylindrical post, over which a three-posted circular belleville-type spring is positioned. Over the central post is positioned a rotary spool, the upper spool portion having a plurality of orifices located therein. Positioned over the top portion of the spool is a rotary cap, which has positioned on its lower surface a plurality of beveled surfaces, having straight rear edges, and adapted to cooperate with the orifices of the top surface of the spool to provide the function of locking and one direction of rotation only during engagement of the spring. The rear housing also includes a clip, for attachment of the rotation closure spool mechanism.

In a preferred embodiment, the rotation closure spool mechanism is adapted for use as a breast enhancement device, and the objects of the invention are attained by providing two separate, independent support stays which are attached in the midline to the rotation closure spool mechanism at distal ends of two strands of twine which extend from the spool. The independent support stays are affixed at their outer ends by a fastening mechanism which then affixes the device to the body band of the brassier proper. Alternatively, the rotation closure spool mechanism of the present invention may be constructed within the brassiere proper, and in such an embodiment the support struts lie inferior to the breast cups which are affixed laterally into the encircling body band holding the brassiere snugly against the frame. In another preferred embodiment of the invention, the rotation closure spool mechanism may be used as an closure device in hats, whereby the size of the hat may be adjusted.

DETAILED DESCRIPTION OF PREFERRED EMBODIMENTS

Referring to the various figures, a detailed description of the rotary closure device, or rotatable and releasable closure spool mechanism of the present invention will be explained, both as a rotation closure spool mechanism, per se, and also in the context of two preferred embodiments in disparate fields of use.

Figure 1:
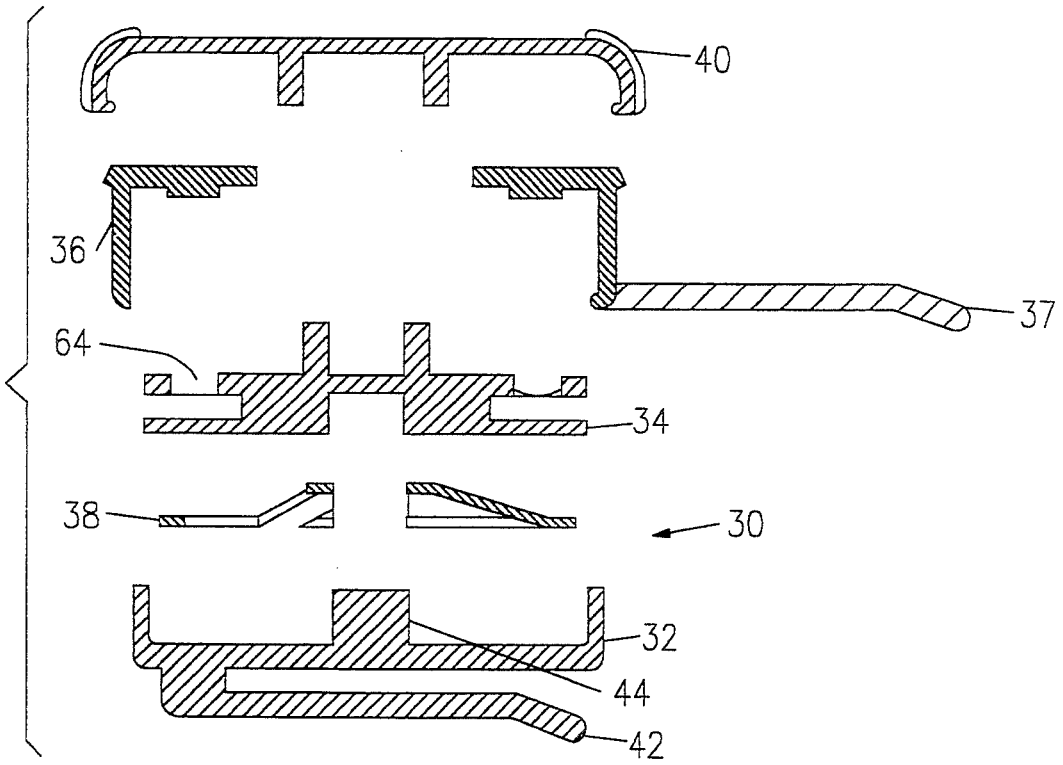
FIG. 1 is an exploded, cross sectional view of the rotation closure device of the present invention.

Referring to FIG. 1, the major components of the rotation closure spool mechanism 1 am shown. Rear, or bottom housing 32 is a generally cylindrically shaped housing which accommodates spool 34, belleville type spring 38, front, or top housing 36, and rotary cap, or knob 40. Extending from the rear of the rear housing 32 is a rear projecting clip 42. Extending from one side of the top housing 36 is a handle grip 37. Extending up from the rear wall and into the central cavity of the rear housing 32 is a cylindrical, solid post, or axle 44 which also functions as a locator projection for the belleville spring 38.

Figure 2:
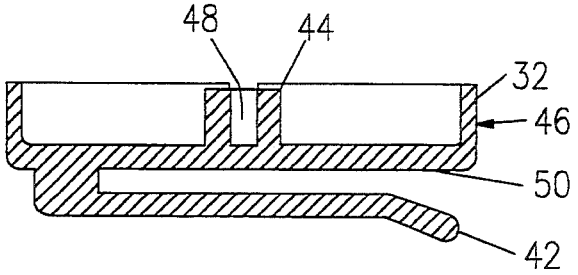
FIG. 2 is a cross sectional view of the rear housing of the FIG. 1 device.
Figure 3:
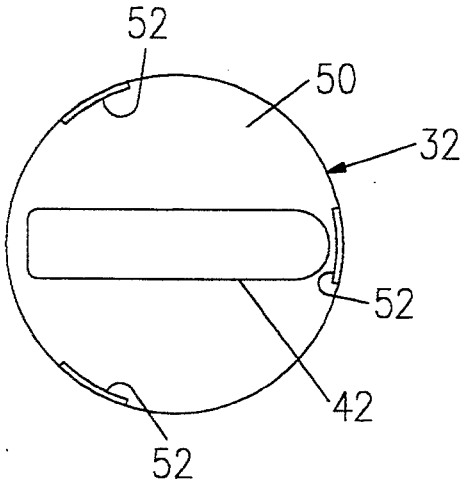
FIG. 3 is a rear view of the rear housing of FIG. 2.
Figure 4:
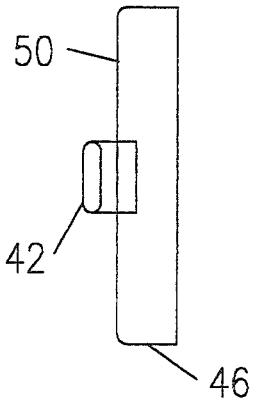
FIG. 4 is a side view of the rear housing of FIG. 2.

Referring to FIGS. 2–5, the rear housing 32 will be described in greater detail. As shown in FIG. 2, the spring locator projection 44 is centrally located, and extends to a height slightly less than the height of the sidewalls 46 of the housing 32. As also shown in FIG. 2, the locator projection 44 may have a central bore 48 formed therein, for anchoring a screw or other fitting, which in turn may be used to fasten the rotary cap 40 to the rear housing 32. The base, or floor of the rear housing 32 is shown in FIG. 2 as bottom wall 50. As shown in FIG. 3, the rear projecting clip 42 extends substantially across the diameter of the rear cap 32 and is generally of a rectangular configuration, with the open end rounded so as to minimize its causing snags, tears and/or cuts. Also shown in FIG. 3 are three projections 52, which are used to fasten the rear housing 32 to the front housing 36 in a conventional snap-lock manner. Referring to FIG. 4, the height of sidewall 46 and the open end of rear projecting clip 42 may be seen.

Figure 5:
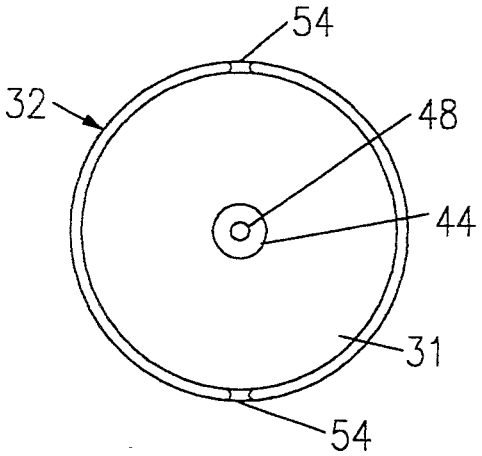
FIG. 5 is a top view of the rear housing of FIG. 2.

In FIG. 5, the locator projection 44, its central bore 48 and the bottom wall or floor 31 may be seen. Also, located at 180° apart are twin, identical bores or channels 54 which function to permit passage of the twine or other thread-type material therethrough.

Figure 6:
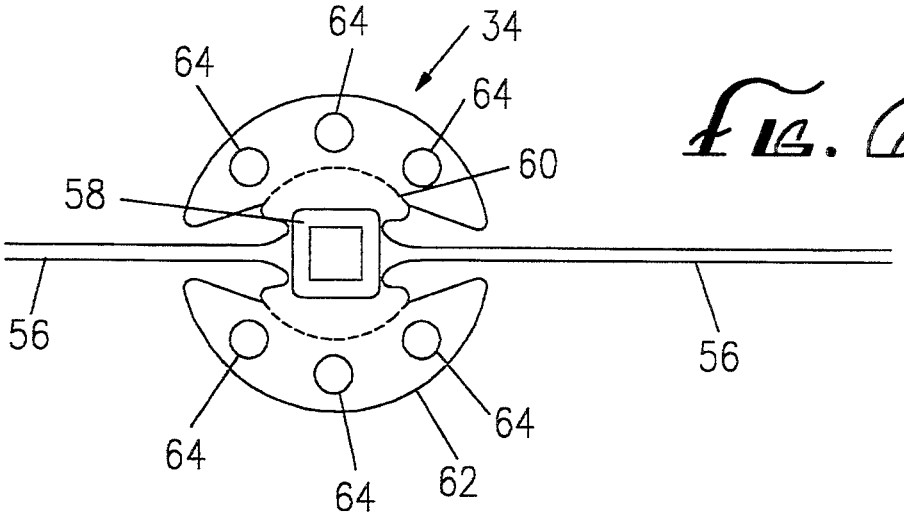
FIG. 6 is a front view of the spool, with twine attached, of the FIG. 1 rotation closure spool mechanism.
Figure 7:
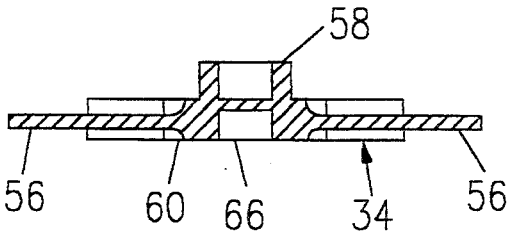
FIG. 7 is a cross-sectional view of the FIG. 6 spool.
Figure 8:
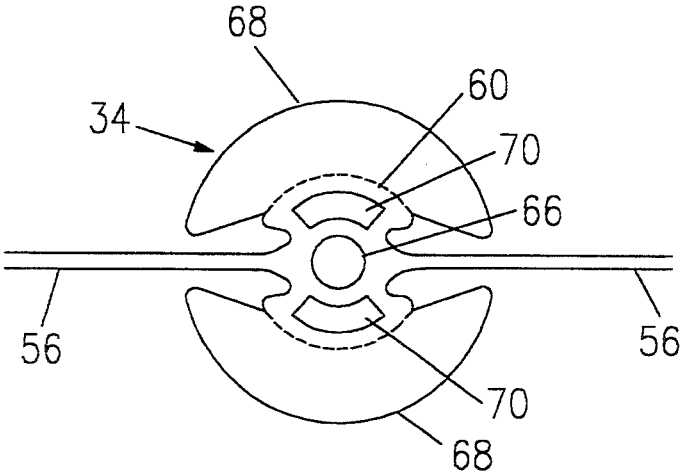
FIG. 8 is a rear view of the FIG. 6 spool.

Referring to FIGS. 6–9, the spool 34 of the rotation closure spool mechanism will be described in greater detail. As shown in FIG. 6, spool 34 has a central post 58, which in the preferred embodiment is a square spline projection. Attached to the square spline 58, in any conventional manner are, preferably, nylon monofilamcnt twine lengths 56, which extend to the left and right, at 180° from each other, as shown. Although the twine lengths are preferably of a nylon monofilament, the twine may be of virtually any material so long as it provides sufficient strength, flexibility and aesthetic features so as to wind around the spline projection 58, be retained within the spool mechanism, and withstand the various forces subjected to it, without breaking during normal use. Also, if the spool and twine are made of injection moldable materials, the spool and twine may be made from a single injection die, i.e., the twine and spool are unitary. Adjacent to and preferably formed integral with the square spline projection 58 is spool cam 60 and the superior, or top surface 62 of the spool 34. Positioned on the top surface 62 of the spool 34 are a plurality of holes, or orifices 64 positioned at 45° and 90° from the line formed by the twine lengths 56. In the preferred embodiment, these holes are cylindrical and adapted to receive beveled projections 82, as more fully described later. The holes 64 and projections 82 function to provide a locking interface for the spool when the spring 38 is engaged. Referring to FIG. 7, the spool 34 is shown in a cross-sectional view taken through the line formed by the twine lengths 56, and illustrating the height or thickness of the spool cam 60, relative to the square spline projection 58, and the twine 56. Also shown, directly opposite the square spline projection 58, and extending, in an open-ended fashion downward, or opposite the direction of the open-ended portion of the spline 58, is the spring spool locator conduit or cavity 66. The cavity 66 is cylindrical in cross-sectional shape, that is, has a round cross-section, to permit rotation and to accommodate the locator projection Referring to FIG. 8, the twine lengths 56, the spool cam 60 and the spool 34 are shown, with spool locator cavity or conduit 66 in the center. The FIG. 8 view of the spool is taken from the bottom, or inferior surface, and shows the inferior surfaces 68 of the spool, together with crescent-shaped manufacturing cavities 70 on either side.

Figure 9:
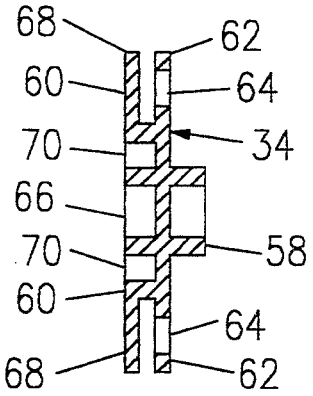
FIG. 9 is a cross-sectional view of the FIG. 6 spool, taken at 90° from the FIG. 8 cross-sectional view.

Referring to FIG. 9, a cross-sectional view of the spool 34, the top, or superior surface 62 of the spool, and the bottom, or inferior surface or wall of the spool 68 are clearly shown, with the cavities 70 therebetween. The spool 68 has two surface for permitting the twine lengths 56 to be retained as the spool is rotated to take up twine as the closure mechanism is operated. Also, the locking interface conduits, or holes 64 am shown in the upper surface 62 of the spool 34, cam 60 is shown in cross-section, and the cavities 70 are also shown in cross-section. The square spline projection 58 and spring spool locator conduit 66 are also shown in cross-section.

Figure 10:
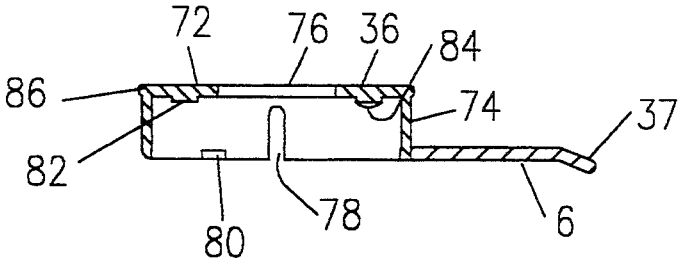
FIG. 10 is a cross-sectional view of the front housing of the rotation closure spool mechanism of FIG. 1.
Figure 11:
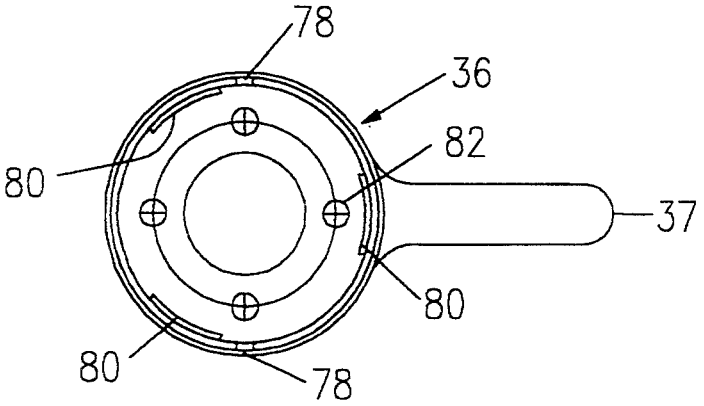
FIG. 11 is a top view of the front housing of FIG. 10.
Figure 12:
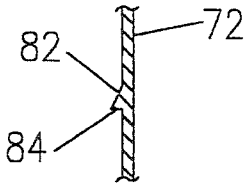
FIG. 12 is a cross-sectional view of a beveled projection of the locking cap of the FIG. 1 rotation closure spool mechanism.

Referring to FIGS. 10–12, the top housing 36 will be described in greater detail. Top housing 36 has a circular top wall 72 and a cylindrical side watt 74, as best illustrated in the cross-sectional view of FIG. 10. In the central portion of the top wail 72 is a bore, or orifice 76. Extending into the cylindrical side wall 74, at two locations, positioned 180° apart, are elongated bores, one of which is shown at 78. The bores 78 function to permit passage of the monofilament twine lengths 56. As also shown in FIGS. 10–12, the bottom, or interior wall of the top wait 72 has positioned thereon a plurality of beveled projections 82. In the preferred embodiment, four such projections 82 are formed integral with the top wall 72 of the top housing 36. The beveling is shown also in the cross-sectional view of FIG. 12, wherein the projection is shown having a gradually rising surface, which is truncated, and its rear portion 84 has a fiat, or straight wall portion which joins to the wall 72 so as to permit a one direction rotation when the spring is engaged. The back, or straight wall portion 84 of the here led projections function as a lock, or brake which prevents rotation of the spool in the opposite direction, because these sharp projections will catch and be retained by the plurality of conduits, or holes 64, as best shown in FIG. 6, and as positioned on the top, or superior surface 62 of spool 34. Also, as shown in FIG. 10, the top housing 36 includes a plurality of female snap fastener openings or slits 80 for permitting the top housing 36 to be snap fit to the rear housing 32, in conjunction with the male snap fastener projection clips 52. Finally, top housing 36 has an extension or handle grip 37 which facilitates holding and operating the spool mechanism.

Figure 13:
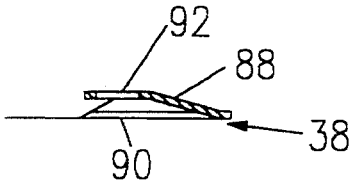
FIG. 13 is a partial cross-sectional view of the belleville spring of the FIG. 1 rotation closure spool mechanism.
Figure 14:
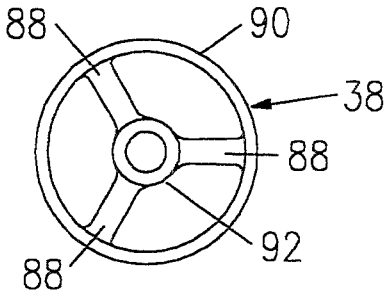
FIG. 14 is a top view of the belleville spring of FIG. 13.
Figure 15:
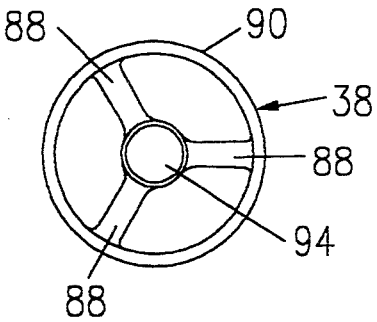
FIG. 15 is a bottom view of the FIG. 13 belleville spring.

Referring to FIGS. 13–15, the belleville-type spring 38 will be described in greater detail.

In the preferred embodiment, the belleville-type spring has three spring flanges 88 which radiate inward from a circular base 90 and are joined to or formed integral with the spring spool locator projection 92. The projection 92 is angular in shape and its central bore 94 fits over and surrounds the locator projection 44 of the rear housing 32.

Figure 16:
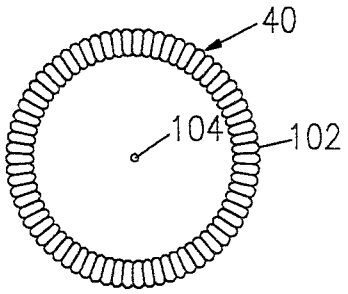
FIG. 16 is a top view of the rotary cap of the FIG. 1 rotation closure spool mechanism.
Figure 17:
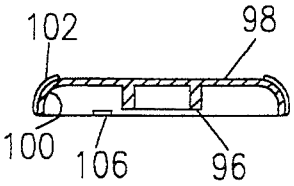
FIG. 17 is a cross-sectional view of the rotary cap of FIG. 16.
Figure 18:
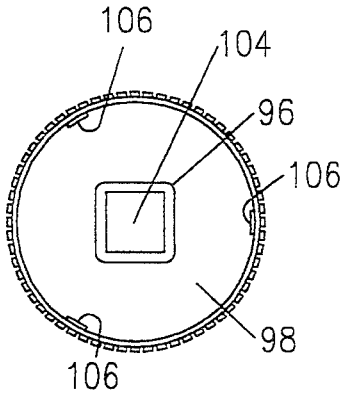
FIG. 18 is a bottom view of the rotary cap of FIG. 16.

Referring to FIGS. 16–18, the rotary cap or knob 40 will be described in greater detail. The rotary cap 40 is generally of a circular cross-section, having a square conduit or square cross-section channel potion 96 which extends downward, or inward from the top wall 98 of the cap. The cap also has cylindrical side wall 100, with an exterior cover 102 which can be of any design of choice, to facilitate a fictional grip by the hand or fingers thereon, such as illustrated in FIG. 16. At the center of the cap, at 104, for example, a small bore or threaded hole 104 may be positioned for permitting a screw to project therethrough and for fastening the top cap to, for example, the spool 34 in a conventional manner. Also shown in FIGS. 17 and 18 are locator, or fastener projections 106. The projections 106 snap fit over the edges 86 of the top housing 36 and provide for movably retaining the cap 40 to the top housing 36.

Figure 19:
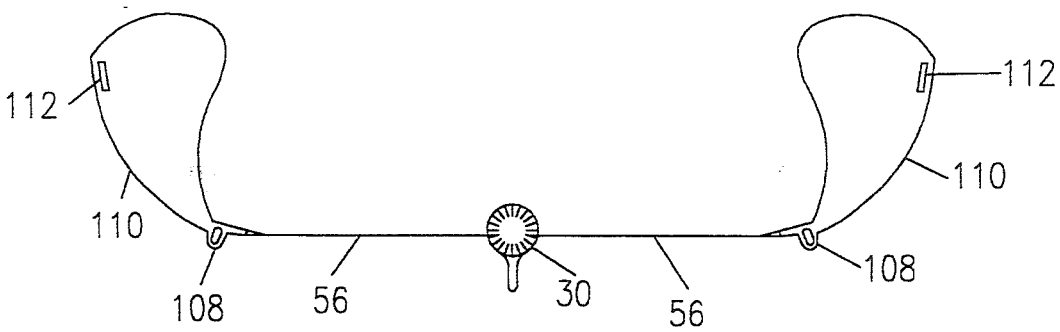
FIG. 19 is a front view of the rotation closure device of the present invention adapted for use in a preferred embodiment as a breast enhancement device.
Figure 20:
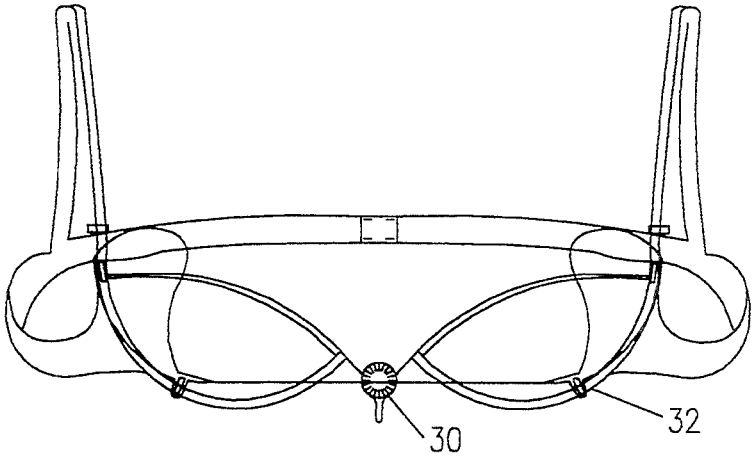
FIG. 20 is a perspective view of the FIG. 1 device, illustrating a typical attachment to a brassiere.
Figure 21:
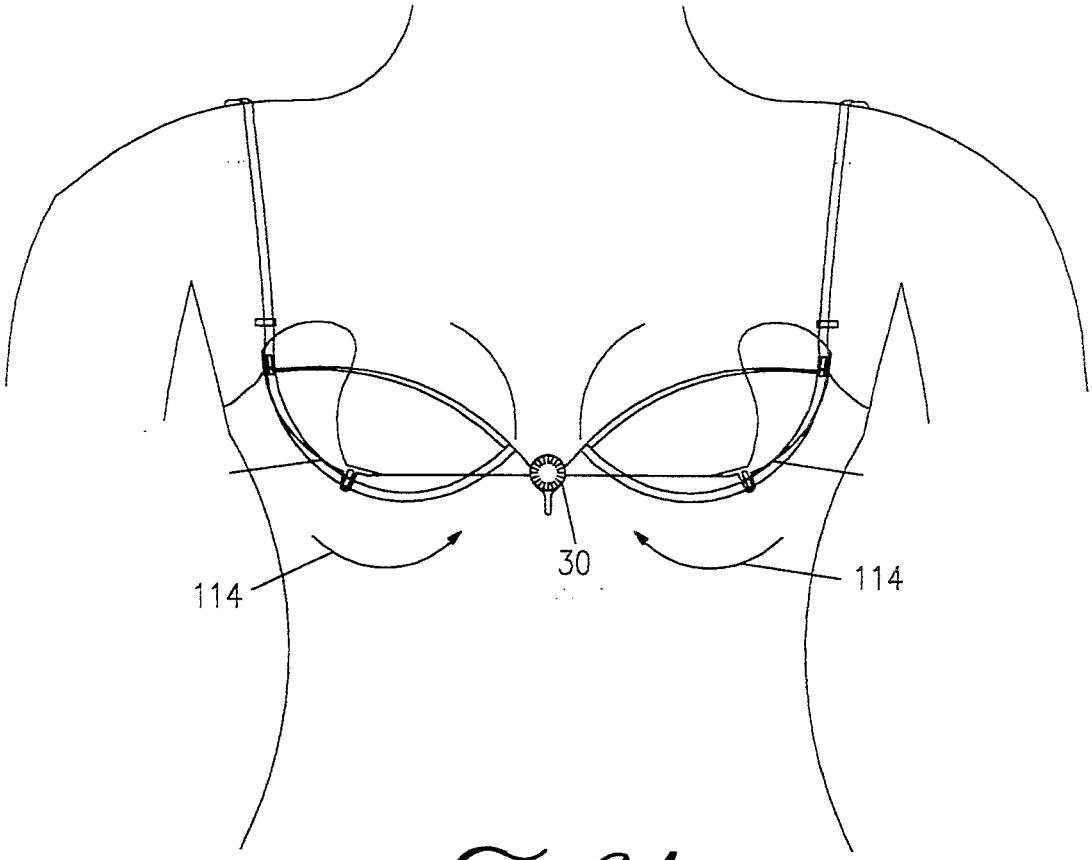
FIG. 21 is a perspective view of the FIG. 20 assembly, shown as worn.
Figure 24:
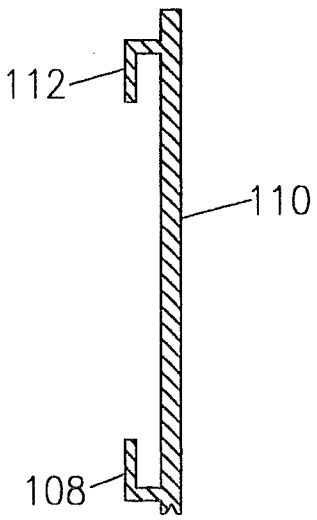
FIG. 24 is a cross-sectional view of a support stay of FIG. 19.

Shown in FIG. 19 is the rotation closure spool mechanism 30, with twine lengths 56 attached at distal ends to a clip guides 108, support stays 110 and suspension clips 112. In the FIG. 19 embodiment, the rotation closure spool mechanism is shown adapted for use as a variable tension, but support device. The de, vice may be affixed conventionally to a brassiere via both a suspension clips 112 and the guide clips 108, as further illustrated in FIGS. 20 and 21. With reference to the arrows 114 of FIG. 21, it my be seen that when the rotation closure spool mechanism 30 is rotated to draw in the twine lengths 56 around the spool 34, then the brassiere, via the attached support stays, and the breasts are drawn in through a medial and superior arc, as illustrated by arrows 114, to provide for variable support and degree of breast separation and cleavage. Referring to FIG. 24, the clips 108 and 112 are shown in greater detail. The clips 108, 112 are adapted and sized to simply clip or fasten over the bra wire or conduit, and bra band, respectively. In this way the present invention may be used with a conventional bra.

Figure 22:
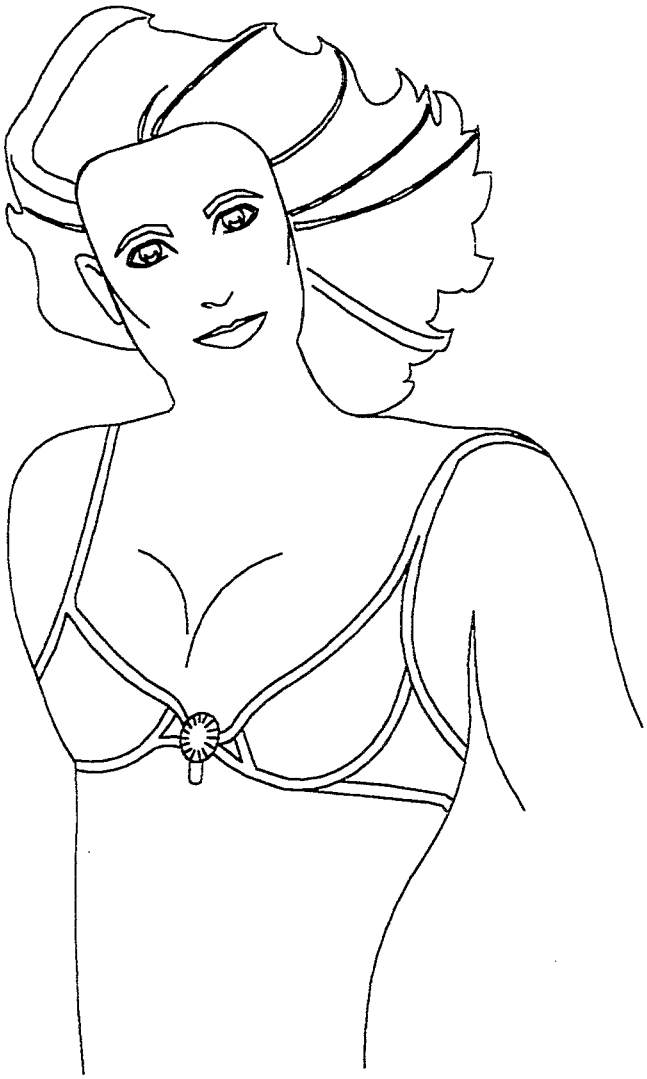
FIG. 22 is a perspective view of the present invention incorporated within the construction of a brassiere.

Referring to FIG. 22, the rotation closure spool mechanism, twine and support stays are formed integral with the brassiere construction itself.

Figure 23:
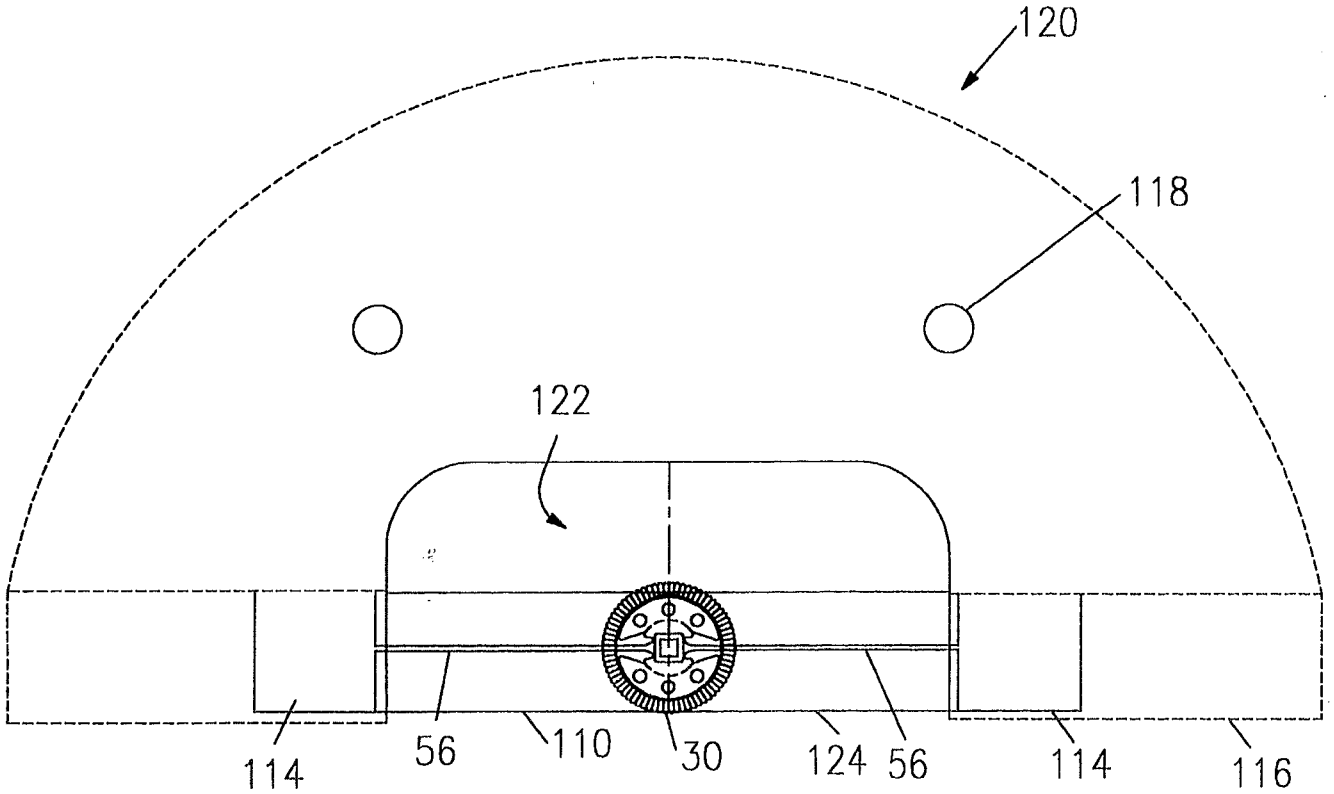
FIG. 23 is a perspective view illustrating the device of the present invention as a baseball type hat closure device, placed at the rear of the hat.

Referring to FIG. 23, the rotation closure spool mechanism is incorporated into a baseball-type hat as a closure or size adjustment mechanism. The hat 120 has vents 118, and a base 116. The rotary closure spool mechanism 30 is shown with twine lengths 56 extending therefrom and being anchored in anchor plates or pieces 114, on either side of the adjustable opening 122. The conduit or cloth band 124 is also shown as covering or concealing the twine lengths 56.

Prior to operation, the station closure spool mechanism is in a rest position, with the twine lengths fully extended, that is, with none of the twine wrapped around the spool. Upon rotation of the rotary cap 40 in the direction of closure while, preferably, the hand holds the grip 37 stationary, the spool rotates, the twine lengths 56 are drawn in and are taken up in the spool 34 to thus draw their distal ends closer together. In the case of the preferred embodiment of the breast cleavage enhance, the brassiere is drawn in as illustrated by arrows 114 in FIG. 21. In the preferred embodiment of use as a hat closure device, rotation of the rotary cap 40, as shown in FIG. 23, will cause the twine lengths 56 to draw in, so that the adjustable opening 122 to be drawn close together as the anchor plates 114 are dram closer together, and thus cause the hat band or cap base to decrease in size, to thus accommodate a smaller-sized head.

Referring to FIG. 1, it may be seen that in the normal, spring engaged configuration, the belleville-type spring 38 forces the spool 34 upward against the rotary cap 40. The beveled projections 82, in conjunction with the conduits or opening 64, operate such that the projections extend into the conduits or orifices 64. If reverse rotation is attempted, the fiat wall 84 of the beveled projection will lock against the side wall of the of the openings 64 and prevent reverse rotation. Only one-way rotation is thus permitted due to operation of the belleville-type spring 38 and cooperation of the beveled projections 82 and the orifices 64 on the top surface of spool 34. In order to release or permit reverse rotation of the spool 8, the top cap 40 must be pressed downward, so that the top cap 40 and spool 34 are prosed down upon and against the spring 38 so as to overcome the force of the three flanges 88. In this way, the beveled projections become separated, in vertical space, from the orifices 64, and thus permit the spool 34 to be rotated in reverse direction. Upon release of the rotary cap 40, and slight rotary adjustment, the beveled projections are rotated so as to be directly opposed to and overlying the orifices 64, to thereby lock the rotation closure spool mechanism to permit only one-way rotation through the normal operation as described above.

What is claimed is:

1. A rotatable closure device comprising:

a cylindrically shaped bottom housing having an open top, closed bottom wall, a side wall of predetermined height and a centrally located, cylindrical projection extending up from the bottom wall to a height which is substantially the same as the height of the side wall;

a belleville spring positioned within the bottom housing, having an annular, central portion surrounding said cylindrical projection, and having a plurality of flanges which are attached to and radiate from said central portion to a circular base;

a spool having a top face, a bottom face and a central bore, the central bore positioned over said centrally located cylindrical projection and the top face having a plurality of holes therein;

a cylindrically shaped top housing having an open bottom, a side wall of predetermined height, an orifice in the top wall, and a plurality of downwardly extending, beveled projections positioned and adapted to cooperate with said plurality of holes in the top face of the spool; and a rotary cap positioned over and rotatably retained by said top housing whereby rotation of the rotary cap is permitted in only one direction when said spring is extended and rotation of the rotary cap is permitted in both directions when said spring is compressed.

2. The rotatable closure device of claim 1 further including two lengths of twine attached to said spool and adapted to wind around said spool upon rotation of said rotary cap.

3. The rotatable closure mechanism of claim 1 further including a clip integral with said bottom housing and extending across the exterior of said closed bottom wall.

4. The rotatable closure mechanism of claim 1 further including two channels, spaced apart by 180° in said top housing.

5. The rotatable closure mechanism of claim 2 wherein the twine and the spool are unitary.

6. The rotatable closure device of claim 2 further including a truncated brassiere cup support stay attached to the distal end of each length of twine, each of said cup support stays including means for fastening to a brassiere.

7. The rotatable closure device of claim 6 wherein the means for fastening to the brassiere includes clip guides.

8. The rotatable closure device of claim 6 wherein the device is constructed integral with the construction of the brassiere.

9. The rotatable closure device of claim 6 wherein each cup support stay is made of a generally rigid material from the group consisting essentially of metal, plastic and fiberglass.

10. A baseball-type hat size adjustment device comprising:

a cylindrically shaped bottom housing having an open top, closed bottom wall, a side wall of predetermined height and a centrally located, cylindrical projection extending out from the bottom wall to a height which is substantially the same as the height of the side wall;

a belleville spring positioned within the bottom housing, having an annular, central portion surrounding said cylindrical projection, and having a plurality of flanges which are attached to and radiate from said central portion to a circular base;

a spool having a top face, a bottom face and a central bore, the central bore positioned over said centrally located cylindrical projection and the top face having a plurality of holes therein;

a cylindrically shaped top housing having an open bottom, a side wall of predetermined height and an orifice in the top wall, and a plurality of downwardly extending, beveled projections positioned and adapted to cooperate with said plurality of holes in the top face of the spool; and a rotary cap positioned over and rotatably retained by said top housing whereby rotation of the rotary cap is permitted in only one direction when said spring is extended and rotation of the rotary cap is permitted in both directions wheel said spring is compressed;

the bottom housing, spring, spool, top housing and rotary cap forming a rotary closure assembly having two lengths of twine attached to the spool, said rotary closure—assembly—being positioned at the back of the hat in an adjustable opening, and the distal ends of each length of twine being attached at an anchor point to the body of the hat whereby rotation of the rotary closure assembly in the direction to draw the twine around the spool causes opposites ends of the adjustable opening of the hat to draw together.

11. The device of claim 10 further including anchors attached to the distal end of each length of twine, each of said anchors attached to opposite sides of the adjustable opening of the host.

12. The device of claim 11, further including a band covering each of said twine lengths.

13. A breast cleavage and separation enhancement device comprising:

a brassiere having two cups;

a cylindrically shaped bottom housing having an open top, closed bottom wall, a side wall of predetermined height and a centrally located, cylindrical projection extending out from the bottom wall to a height which is substantially the same as the height of the side wall;

a belleville spring positioned within the bottom housing, having an annular, central portion surrounding said cylindrical projection, and having a plurality of flanges which are attached to and irradiate from said central portion to a circular base;

a spool having a top face, a bottom face and a central bore, the central bore positioned over said centrally located cylindrical projection and the top face having a plurality of holes therein;

a cylindrically shaped top housing having an open bottom, a side wall of predetermined height and an orifice in the top wall, and a plurality of downwardly extending, beveled projections positioned and adapted to cooperate with said plurality of holes in the top face of the spool; and a rotary cap positioned over and rotatably retained by said top housing whereby rotation of the rotary cap is permitted in only one direction when said spring is extended and rotation of the rotary cap is permitted in both directions when said spring is compressed;

said bottom housing, spring, spool, top housing and rotary cap operatively positioned on and attached to the brassiere in a portion between the cups and having two lengths of twine attached to said spool, the distal ends of each length of said twine being attached to a breast cup support stay, whereby rotation of the closure mechanism in a direction to draw the twine around the spool causes the stays to be pulled closer together, thus pulling the cups closer together.

* * * * *